US005845423A

United States Patent [19]

Hicks

[11] Patent Number: 5,845,423

[45] Date of Patent: Dec. 8, 1998

[54] ADVETISING SUBSTRATE ATTACHABLE TO TRUCKS

[76] Inventor: Charles H. Hicks, 13908 Lake Point Dr., Clearwater, Fla. 34622

[21] Appl. No.: 925,350

[22] Filed: Sep. 8, 1997

Related U.S. Application Data

[63] Continuation of Ser. No. 591,055, Jan. 25, 1996, abandoned.

[51] Int. Cl.[6] ..... G09F 17/00

[52] U.S. Cl. ..... 40/603; 40/590; 160/328

[58] Field of Search ..... 40/590, 591, 603, 40/604; 160/328, 387, 388, 392, 395

[56] References Cited

U.S. PATENT DOCUMENTS

| | | | |
|---|---|---|---|
| 4,756,107 | 7/1988 | Hillstrom | 40/603 |
| 5,046,545 | 9/1991 | Loomis et al. | 160/328 X |
| 5,349,772 | 9/1994 | Pardue | 40/590 |
| 5,408,770 | 4/1995 | Suzuki | 40/603 X |
| 5,507,109 | 4/1996 | Rinzler | 40/603 |

*Primary Examiner*—Brian K. Green
*Attorney, Agent, or Firm*—Ronald E. Smith

[57] ABSTRACT

A substrate upon which an advertising message may be printed is releasably attachable to the side of a truck in a way that prevents the substrate from flapping when the truck is moving at high speeds. The upper and rearward edges of the substrate are retained within rigid frames mounted to the truck and are quickly insertable into or removable from such rigid frames. The forward edge of the substrate is wrapped around the forward corner of the truck trailer so that wind cannot get under the substrate, and a plurality of front-mounted winches pull the forward edge toward them so that slack is removed from the substrate. Another plurality of winches mounted on the underside of the trailer engage straps that hold the lowermost edge of the substrate so that activation of the winches pulls the lowermost edge toward those winches to further remove slack from the substrate. Another embodiment adds sailboat-like battens to further inhibit substrate flapping and a final embodiment replaces the front-mounted winches with a take-up reel arrangement.

8 Claims, 7 Drawing Sheets

ADVETISING SUBSTRATE ATTACHABLE TO TRUCKS

This application is a continuation of application Ser. No. 08/591,055 filed Jan. 25, 1996 which application is now abandoned.

BACKGROUND OF THE INVENTION

1. Field of the invention

This invention relates, generally, to an apparatus for removably attaching an advertising sign to the side of a truck.

2. Description of the prior art

The number of billboards available for use by the outdoor advertising industry is shrinking, for several reasons. Many government entities are ruling that billboards are "nonconforming structures," for example, and providing for amortizing periods. Road rights-of-way are being widened, developers are utilizing roadside land for alternate uses, and so on. Nonetheless demand for outdoor advertising space remains strong.

What is needed, then, is a new platform for outdoor, i.e., billboard-type advertising.

The side panels of conventional trucks, semitrailers, and other types of trucks (hereinafter referred to collectively as trucks) are approximately the same size as billboards; accordingly, if such space could be put to advantageous use, such side panels could serve as an additional platform for outdoor advertising space.

Some advertisers have painted an advertising copy and artwork directly onto the side panels of trucks. The copy, typically, includes a company's name, its slogan, a picture, or the like. Painted advertising copy is acceptable, however, only if the message is substantially permanent; frequent changes of advertising messages through repainting is clearly impractical. Thus, a company whose primary business is not trucking using its own private truck fleet might find it practical to paint the company's name, artwork, and slogan on all trucks of the fleet, but the company will not be able to economically change its advertising copy (e.g., to promote different products) during the various seasons of the year. This restricts the company to unchanging and therefor less effective advertising. What is needed, then, is a means that would enable private truck fleet owners to change their truck-side advertising copy for seasonably-sensitive (Christmas, etc.) product promotions. Specific products or advertising tie-ins with vendors to retail establishments could also be promoted more easily.

Moreover, there are many For Hire Common Carrier truck fleets, i.e., trucks owned by trucking companies or individual owner-operators, that are used to transport goods of many different companies. Therefore, it is not practical to apply advertising signs having any degree of permanency to trucks of this type. Thus, the valuable advertising space on the sides of such trucks is underutilized.

Recent developments in the outdoor advertising (billboard) industry include the use of single piece reinforced vinyl fabric sheets as the substrate upon which an advertising message may be hand painted or otherwise applied. Advances in computer technology, including ink-jet printing systems, have also enabled the application of intricate advertising messages and designs onto such substrate.

However, the industry still has not developed an optimal means for quickly attaching and detaching such substrate to the side panels of trucks.

Several inventors have developed systems for facilitating the temporary attachment of an advertising message to the side of a truck. An earlier construction having some similarity to the present disclosure appears in U.S. Pat. No. 5,373,655 to Suzuki. A poster in the form of a vinyl or fabric sheet is held in position by a structure that includes a sliding track or rail, a frame, a rope, and tensioning means including tension adjusters.

Although the Suzuki and other early changeable copy advertising panels perform their intended functions, they are difficult and time-consuming to install if unskilled labor is used. Some of the earlier designs also detract from the appearance of the truck. For all of these reasons, the earlier designs have not met with substantial acceptance in the marketplace.

What is needed, then, is a removably mounted advertising substrate for use on a truck and a novel means for quickly and easily installing, adjusting, or removing such substrate that does not require skilled labor. The advertising substrate, once installed, should not flap in the wind, nor should its attachment means detract from the appearance or function of the truck.

However, in views of the pertinent art at the time the present invention was made, it was not obvious to those of ordinary skill in such art how the needed apparatus could be provided.

SUMMARY OF THE INVENTION

The longstanding but heretofore unfulfilled need for an apparatus that overcomes the limitations of the prior art is now met by an apparatus that is easily and quickly attachable to or detachable from the side of a truck, which does not flap in the wind at highway speeds, and which does not detract from the appearance of the truck.

The novel apparatus attaches a flexible substrate, having a predetermined longitudinal and vertical extent, to a support surface such as a side of a truck.

The assembly includes an upper attachment means for releasably attaching a longitudinally extending upper edge of the substrate to a longitudinally extending upper edge of the truck, a rearward attachment means for releasably attaching a vertically extending rearward edge of the substrate to a vertically extending rearward edge of the truck, a forward attachment means for releasably attaching a vertically extending forward edge of the substrate to a transversely disposed front wall of the truck, and a lower attachment means for releasable attaching a longitudinally extending lower edge of the substrate to a longitudinally extending lower edge of the truck.

More particularly, the forward attachment means is adapted to releasably attach a vertically extending forward edge of the substrate to a transversely disposed front wall of a truck. The flexible substrate bends around a vertically disposed forward edge of the truck to prevent air from flowing in a space between said substrate and a side of the truck. In a first embodiment, a plurality of winches is mounted to said transverse wall to tension the substrate as required. In a second embodiment, the winches are eliminated in favor of an apparatus that includes an upstanding reel for the take-up and tensioning of substrate.

It is a primary object of the invention to provide an advertising platform in the form of a flexible substrate that is quickly and easily attachable to and removable from the sides of a truck.

Another important object is to provide novel attachment means for securing said substrate to a truck in a form that is not subject to lapping when subjected to high speed winds of the type encountered in highway travel.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
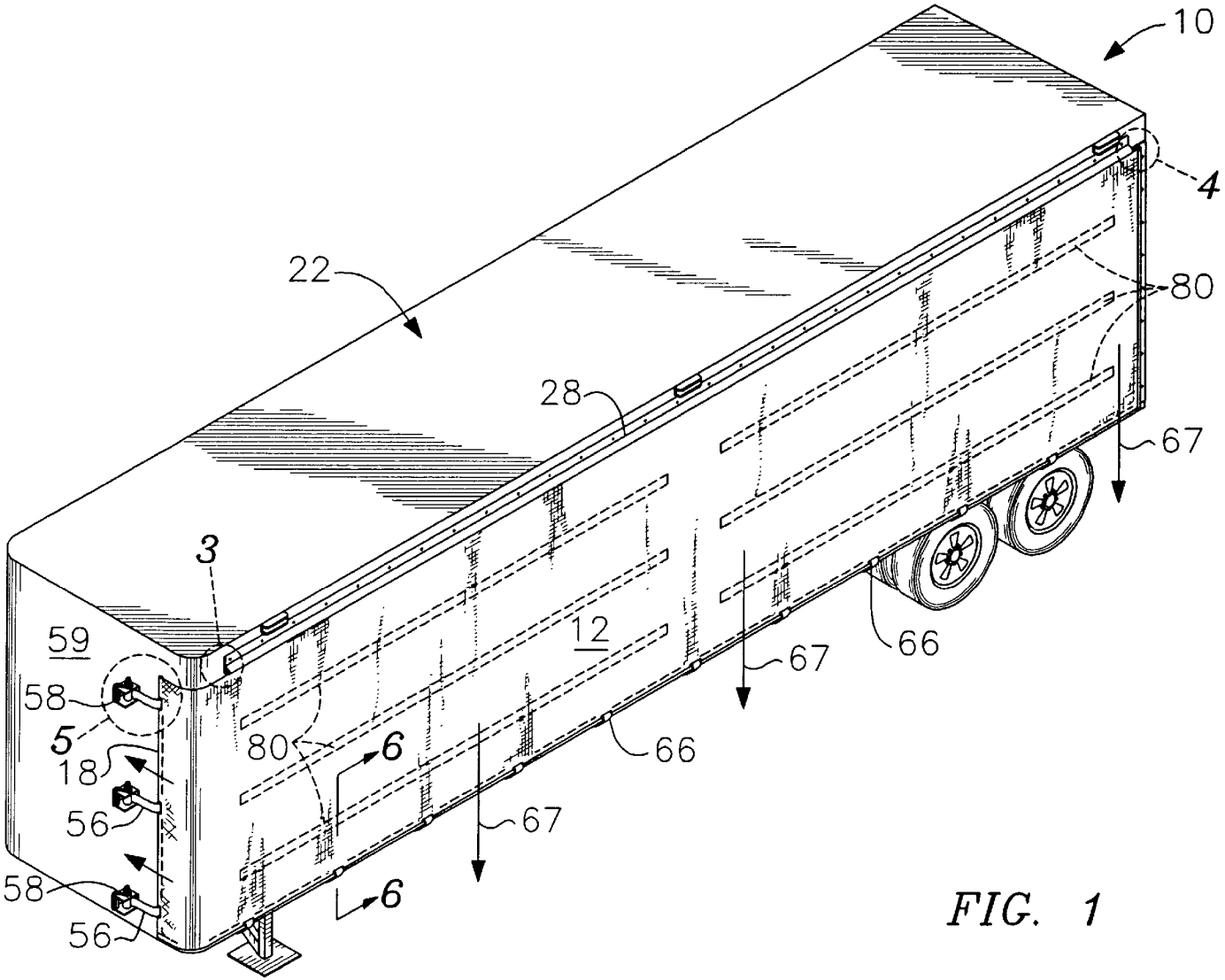
FIG. 1 is a perspective view of a truck trailer equipped with an illustrative embodiment of the invention.
Figure 2:
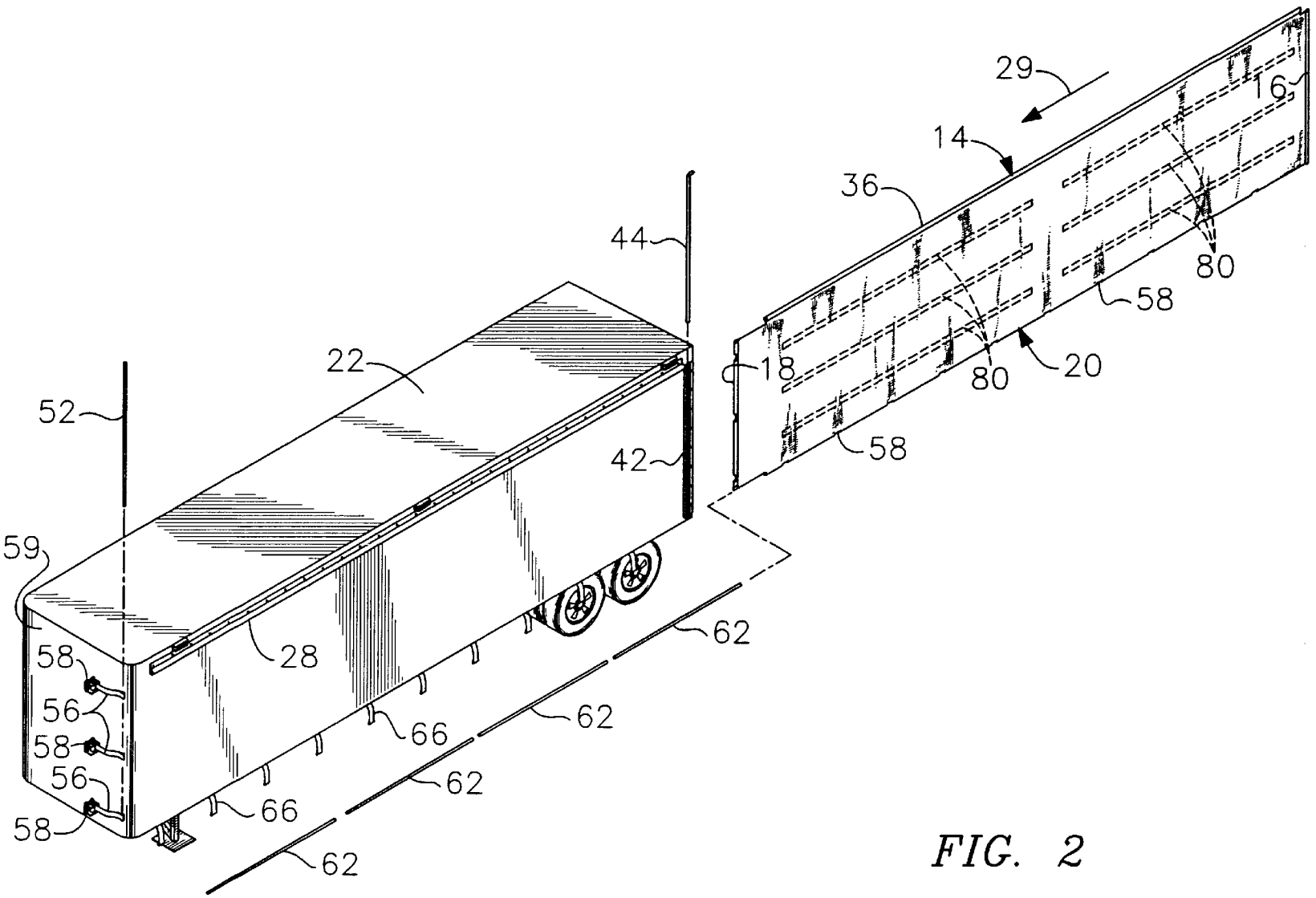
FIG. 2 is an exploded perspective view of the parts depicted in FIG. 1.

Referring now to FIGS. 1 and 2, it will there be seen that an exemplary embodiment of the invention is denoted as a whole by the reference numeral 10.

Substrate 12 is made of a suitable flexible material such as the same material commonly used as a substrate on conventional roadside billboards, i.e., a reinforced vinyl fabric. Other suitable materials are within the scope of this invention.

Substrate 12 is of rectangular shape to correspond to the shape of a truck side wall. As best understood in connection with FIG. 2, it includes longitudinally extending upper edge 14, vertically extending rearward edge 16, vertically extending forward edge 18, and longitudinally extending lower edge 20.

Figure 3:
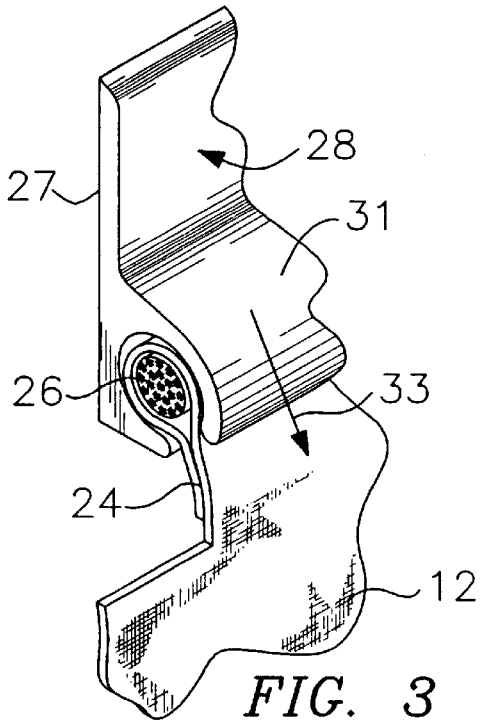
FIG. 3 is a detailed perspective view of the encircled parts in FIG. 1 denoted 3.
Figure 3A:
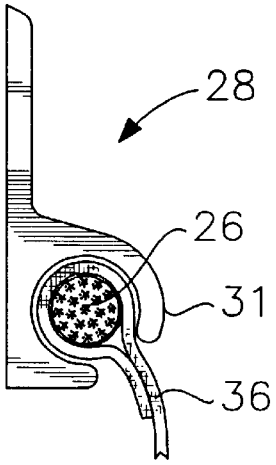
FIG. 3*a* is a side elevational view of the parts depicted in FIG. 3.
Figure 3B:
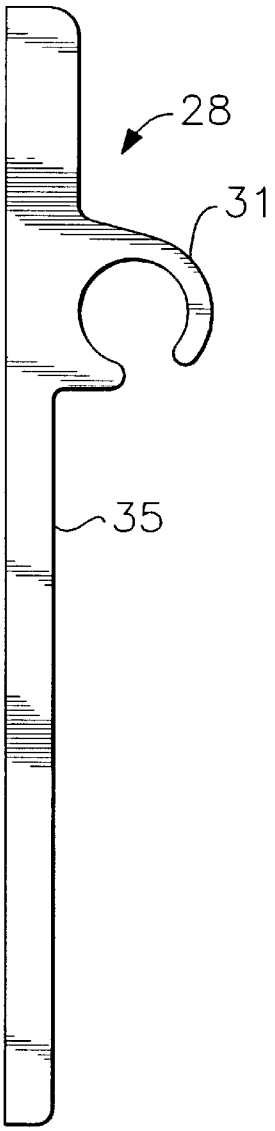
FIG. 3*b* is a side view of an alternative embodiment.

The means for attaching longitudinally extending upper edge 14 of substrate 12 to the corresponding edge of trailer 22 is depicted in FIGS. 3, 3*a*, and 3*b*. The novel structure includes an upper hem 24 formed in substrate upper edge 14. The upper edge forms an elongate upper loop which receives elongate upper hem loop-occupying member 26 which may be provided in the form of a rope, rod, cylinder, flat bar, or other substantially noncompressible member. In the preferred embodiment of the invention, a rope 26 is positioned within substrate upper hem 24 at the time said hem is sewn, sealed, or otherwise formed into the substrate, i.e., the rope is placed into overlying relation to the substrate near the upper edge thereof, and the fabric is folded over said rope and the hem is sewn or otherwise formed tightly around the rope or other member 26 so that it is snugly held. Of the four edges of the substrate, only the upper edge is first fitted with a rope or other loop-occupying member prior to formation of the hem.

As indicated in FIG. 2, a rigid frame 28 is permanently attached to the truck along its longitudinally extending upper edge, and said substrate upper hem 24 and said elongate upper hem-occupying member 26 are slidingly introduced into and retained by said rigid frame 28, as indicated by directional arrow 29.

Note in FIG. 3 that flat base 27 of frame 28 is secured by suitable means to the trailer, and that housing part 31 thereof that slideably receives hem 24 and rope 26 is made of a rigid material so that said hem and rope cannot be pulled therefrom in the direction of arrow 33.

In the alternate embodiment of FIG. 3*b*, rigid frame 28 is formed integrally with a truck structural frame 35 to eliminate the step of affixing frame 28 to said truck; it should be understood that the sidewalls of a truck are usually framed with a structural frame.

Figure 4:
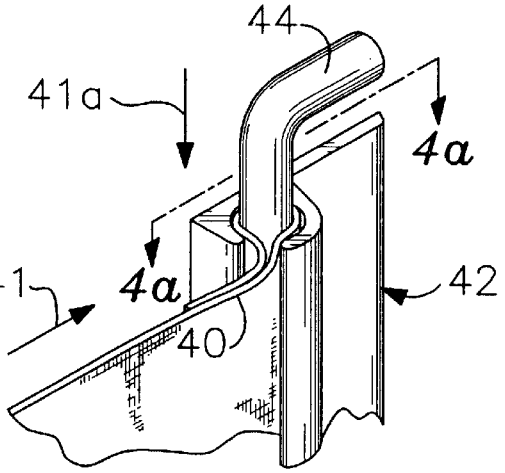
FIG. 4 is a detailed perspective view of the parts encircled in FIG. 1 and denoted 4.
Figure 4A:
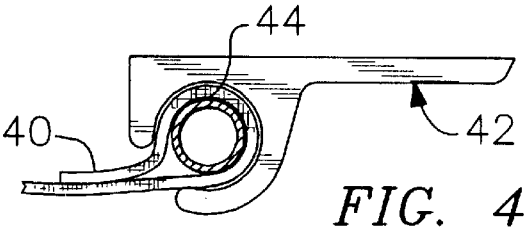
FIG. 4*a* is a sectional view taken along line 4*a*—4*a* in FIG. 4.

The means for securing the rearward or trailing end 16 of substrate 12 is depicted in FIGS. 4 and 4*a*; it is similar to but different from the means for securing the upper edge thereof. The rearward attachment means includes a rearward hem 40, said rearward hem forming an elongate rearward loop in the vertically extending rearward edge of substrate 12. This rearward loop is inserted, in the manner indicated by directional arrow 41, into a rigid rearward frame 42, having a structure like rigid upper frame 28, that is attached to the truck trailer along its vertically extending rearward edge. An elongate, rigid rearward hem loop-occupying member 44 is then axially inserted into said elongate rearward loop, as indicated by directional arrow 41*a*. As depicted in FIGS. 2 and 4, the uppermost end of member 44 may be bent, beaded, or otherwise formed so that it engages the uppermost edge of frame 42 so that it is suspended thereby. Alternatively, the lowermost end of the rearward loop is sewn shut or otherwise closed to support member 44 from the bottom. Any suspended mounting of member 44 is preferred; the invention is not limited to the particular suspension means depicted.

It should be observed that upper rigid frame 28 and rearward rigid frame 42 are preferably permanently mounted to a truck that will be used as an advertising platform. Thus, the above-mentioned steps of installing such rigid frames is not carried out each time an advertising message is changed.

Figure 5:
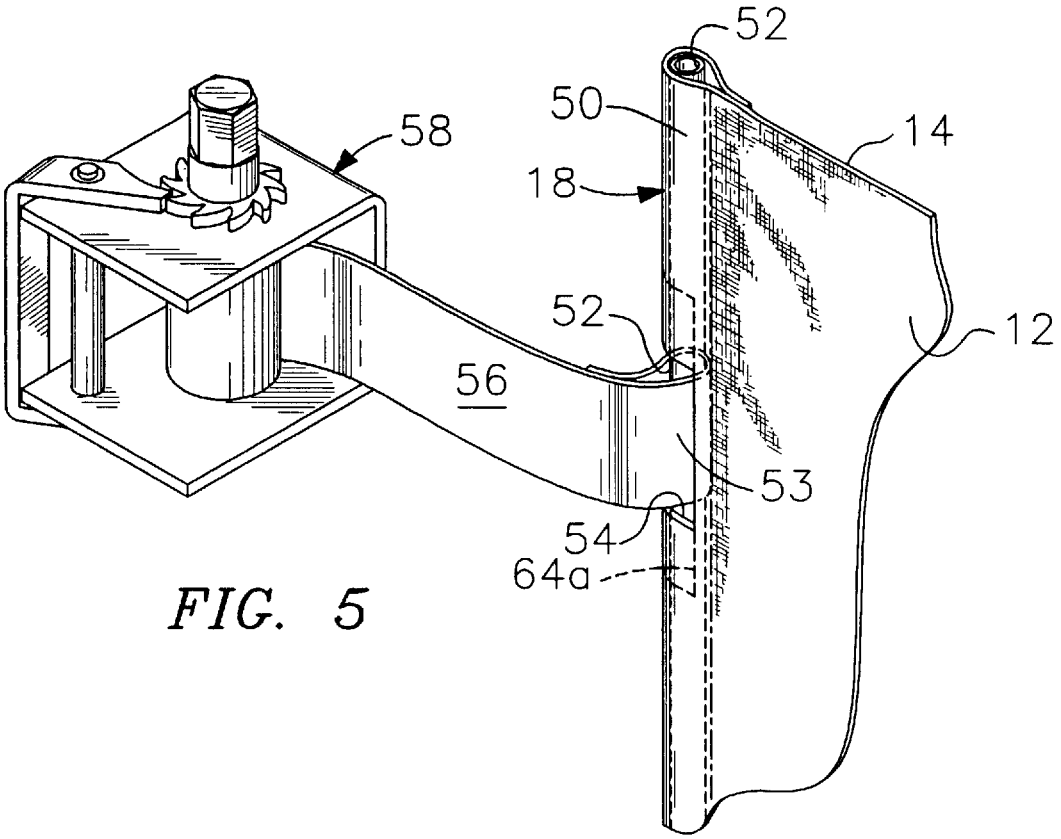
FIG. 5 is a perspective view of the parts encircled in FIG. 1 and denoted 5.

As best depicted in FIG. 5, an elongate forward hem 50 is formed in vertically extending forward edge 18; it forms an elongate forward loop that slideably receives therein an elongate forward hem loop-occupying member 52 which may take the form of a rigid rod, cylinder, pipe, flat strap, or the like.

At least one opening 54 is formed in elongate forward hem 50, and at least one substrate-tightening strap 56 having a first end disposed in engaging relation to elongate forward hem-occupying member 52 is in registration with said at least one opening. Preferably, each strap first end has a loop 53 formed therein for slideably receiving loop-occupying member 52. Where a plurality of straps are employed as in the depicted embodiment, member 52 is sequentially introduced into said strap loops as said member 52 is slideably and axially inserted into said loop defined by substrate forward hem 50.

At least one finch means 58 is mounted on transversely disposed forward wall 59 (FIG. 1) of truck 22, and said at least one substrate-tightening strap 56 has a second end engaged by said winch means 58. Accordingly, operation of winch means 58 in first direction coils said at least one strap 56 about said winch means and thus pulls substrate 12 forwardly to inhibit flexing thereof in response to air movement thereacross. Operation of winch means 58 in a second direction opposite to the first direction loosens substrate 12 and facilitates removal of forward hem-occupying member 52 from elongate forward hem 50.

Each winch means 58 is best mounted on a structural member that underlies truck forward wall 59.

Figure 6:
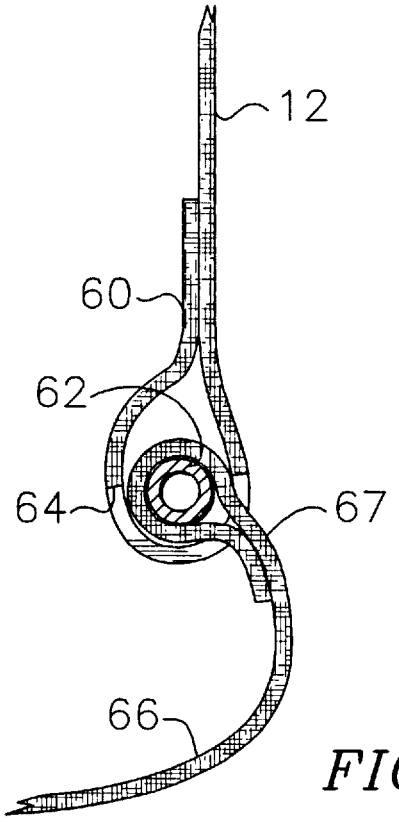
FIG. 6 is a sectional view taken along line 6—6 in FIG. 1.
Figure 7:
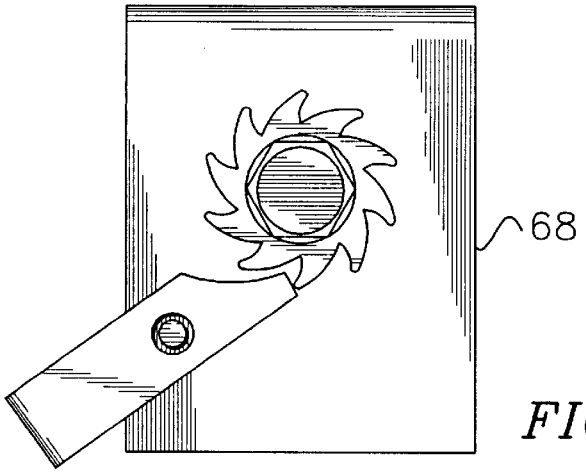
FIG. 7 is a side elevational view of a winch.
Figure 8:
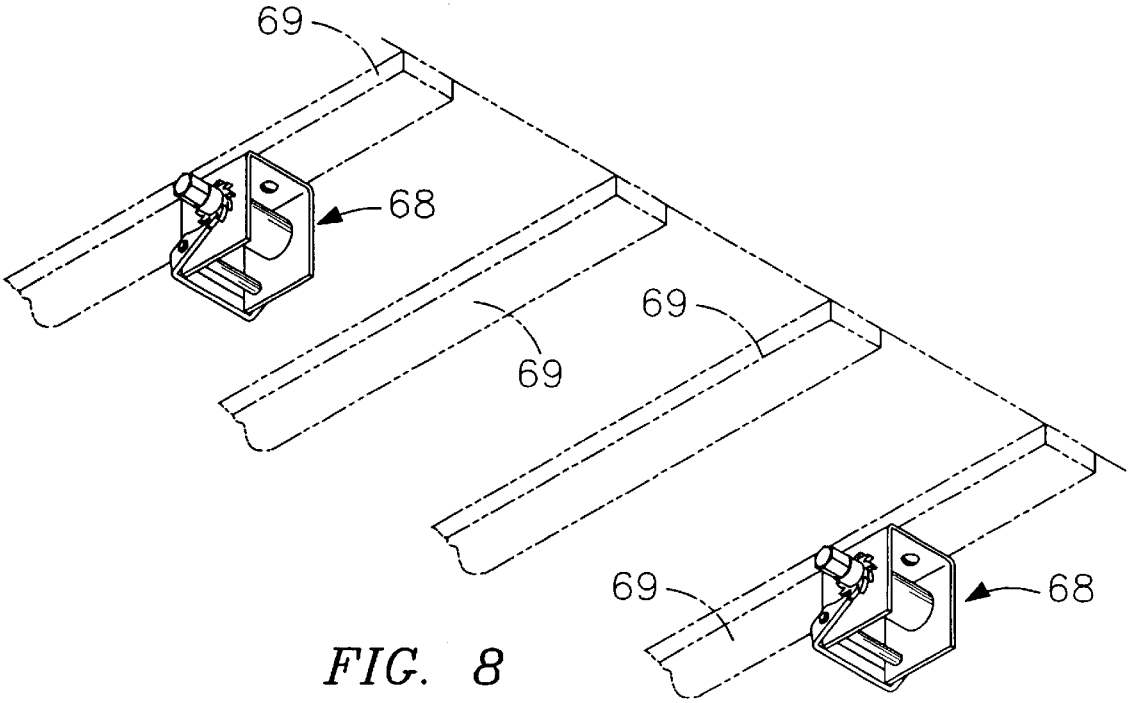
FIG. 8 is a perspective view of the underside of a truck trailer equipped with winches.

The lower attachment means is substantially similar to the forward attachment means. As indicated in FIG. 6, it includes an elongate lower hem 60 forming an elongate lower loop in longitudinally extending lower edge 20 of substrate 12; an elongate lower hem loop-occupying member 62, which may be provided in multiple sections as indicated in FIG. 1, is slideably received within said elongate lower loop. At least one opening 64 is formed in elongate lower hem 60 and at least one substrate-tightening strap 66 having a first end 67 disposed in engaging relation to said elongate lower hem-occupying member 62 is in registration with said at least one opening 64. At least one winch means 68 (FIG. 7), operated by a ratchet and pawl mechanism, is mounted to an underside of the truck on cross frames 69 as indicated in FIG. 8; said at least one substrate-tightening strap 66 has a second end engaged by said at least one winch means. Accordingly, operation of said at least one winch means in a first direction coils said at least one strap about said at least one winch means and thus pulls substrate 12 downwardly as at 67 (FIG. 1) to inhibit flexing thereof in response to air movement thereacross. Operation of said at least one winch means in a second direction opposite to said first direction loosens the substrate and facilitates removal of lower hem-occupying member 62 from elongate lower hem 60.

Figures 9, 9A:
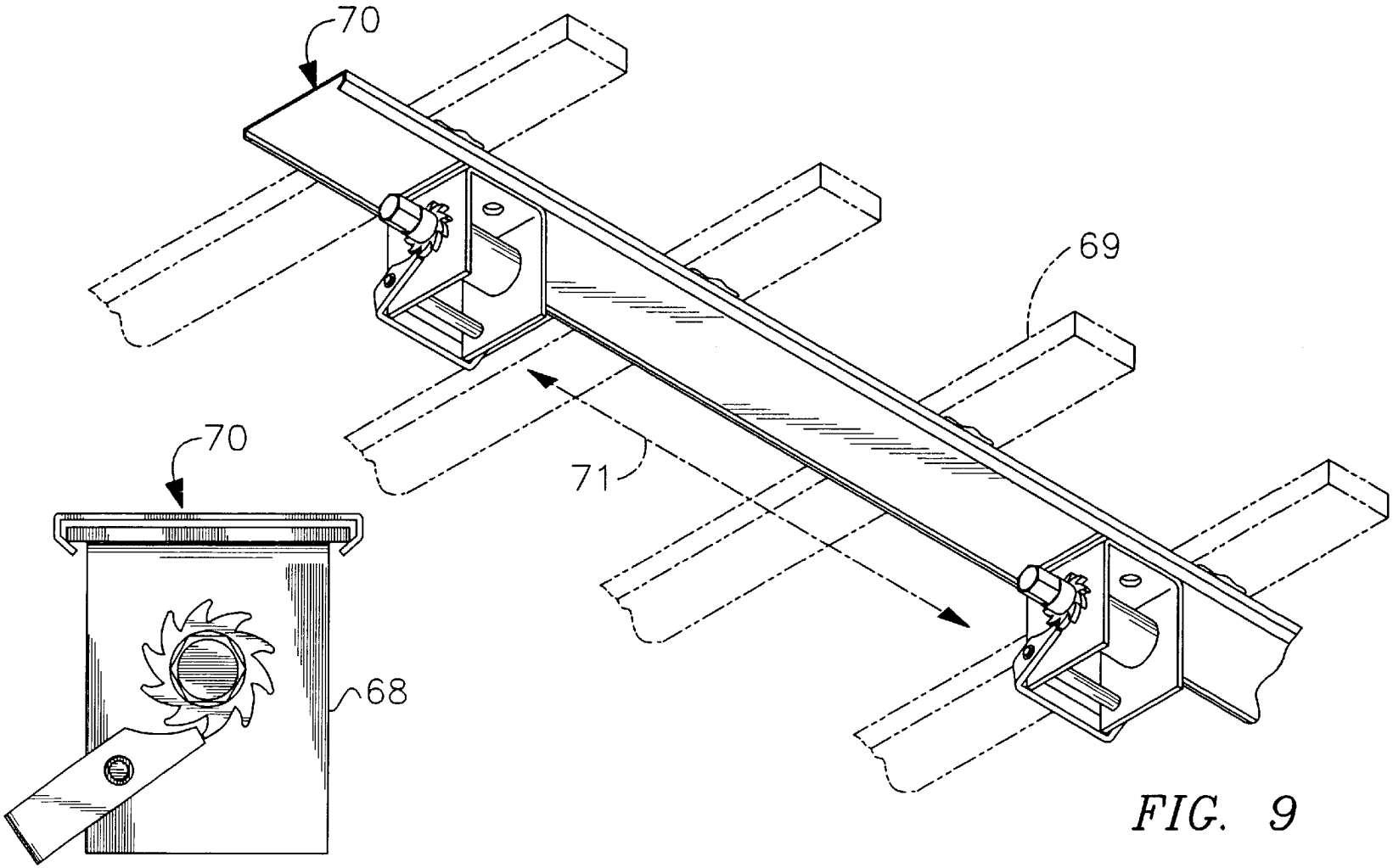
FIG. 9 is a perspective view of the underside of a truck having winches mounted for movement along a track.
FIG. 9*a* is an end view of the parts depicted in FIG. 9.

In the embodiment of FIG. 9, each winch means is mounted on a longitudinally-extending track 70. This enables the position of each winch means to be adjusted forwardly and rearwardly as indicated by double-headed directional arrow 71 so that the positioning of strap openings 64 and straps 66 is not critical. Note that strap openings 64*a*, indicated in broken lines in FIG. 5, (in connection with winches 58) may be of greater longitudinal extent than the straps which they receive to facilitate alignment of the winches and their associated straps. The shape of track 70 is perhaps best understood in connection with FIG. 9*a*.

The length of straps 66 is adjustable so that substrate 12 extends over the longitudinally extending lower edge of the truck or so that just the straps themselves extend over said edge as depicted in FIG. 1. In the former, unillustrated configuration, the substrate would wrap under the trailer in the same way it wraps around the leading end of the trailer as depicted in FIG. 1.

In the attachment means for both the forward and lower edges of substrate 12, there are preferably a plurality of equidistantly spaced apart slots and winches as depicted in the Figures.

In a second embodiment, also depicted in FIGS. 1 and 2, one or more elongate strengthening members, collectively denoted 80, are mounted to the underside of substrate 12. More particularly, said members 80 are slideably received within pockets defined by suitable means on said reverse side of the substrate; accordingly, they resist flapping of the substrate in the same manner that battens prevent flapping of sails in sailboats.

Rigid frames 28 and 42 are preferably permanently mounted to the upper and rearward edges of the trailer, respectively, as mentioned earlier. They will not be noticed by casual observers of the trailer when no advertising-carrying substrate is installed thereon. Similarly, winches 58 and 68 for tightening the forward and lower edges of the substrate, respectively, are also permanently mounted on the trailer; those winches on the underside of the truck are substantially hidden from view.

Figure 10:
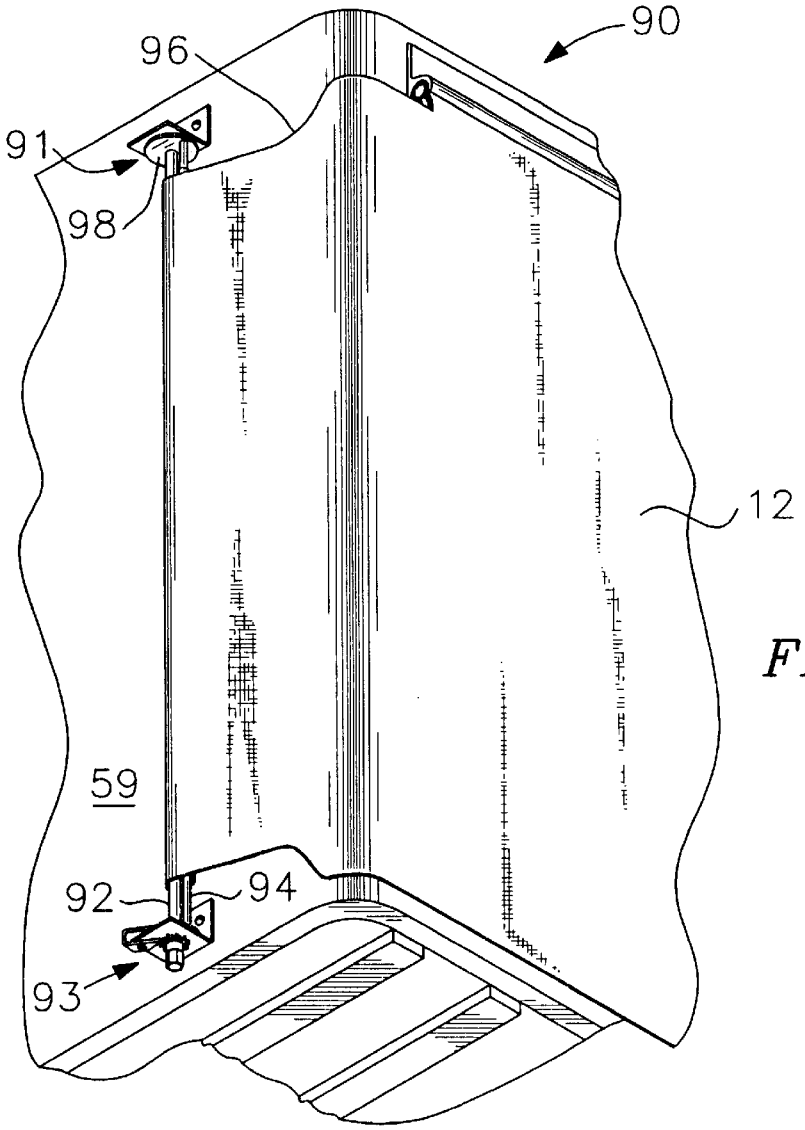
FIG. 10 is a perspective view of an alternative embodiment.

In another embodiment of the invention, winches 58 are replaced by a mechanism depicted in FIG. 10 and denoted 90 as a whole. Leading forward edge 18 of substrate 12 (tapered downwardly as at 96) is attached to upstanding take-up reel 92, and a manual or motor-driven ratchet and pawl 93 or other suitable mechanism is positioned at the lowermost end of reel 92 to rotate said reel about its axis. The opposite ends of reel 92 are secured to mounting plate 98; in concentric relation thereto; said mounting plates are rotatably mounted to brackets 91, 93 to which are secured to truck forward wall 59.

Figure 11:
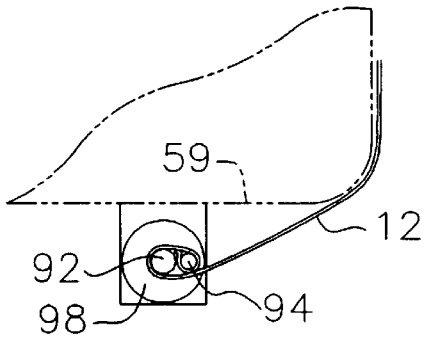
FIG. 11 is a top plan view of still another alternative embodiment.

As perhaps best understood in connection with FIG. 11, substrate 12 extends over elongate core 94 that is positioned in spaced apart, parallel relation to said reel, i.e., in eccentric relation thereto. Rotation of mounting plates 98 in a first direction tightens substrate 12 and rotation of said mounting plates in a direction opposite to the first direction loosens substrate 12 so that it can be removed from the truck.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus in combination with a support surface and a flexible substrate, comprising:

said support surface having a vertically extending corner formed by a longitudinally disposed, upstanding side wall and a transversely disposed, upstanding front wall, and said support surface including a longitudinally extending corner formed by said upstanding side wall and a bottom wall disposed normal to said side wall and said front wall;

said flexible substrate having a predetermined longitudinal and vertical extent;

said flexible substrate having a longitudinally extending upper edge, a longitudinally extending lower edge, a vertically extending forward edge, and a vertically extending rearward edge;

upper attachment means for releasably attaching said longitudinally extending upper edge of said substrate to a longitudinally extending upper edge of said side wall;

said upper attachment means being permanently secured to said side wall;

rearward attachment means for releasably attaching said vertically extending rearward edge of said substrate to a vertically extending rearward edge of said side wall;

said rearward attachment means being permanently secured to said side wall;

forward attachment means adapted to releasably attach said vertically extending forward edge of said substrate to said transversely disposed front wall, said flexible substrate bending around said vertically extending corner so that air cannot flow between said side wall and said substrate;

said forward attachment means being permanently secured to said front wall;

lower attachment means for releasably attaching said longitudinally extending lower edge of said substrate to a longitudinally extending lower edge of said side wall;

said lower attachment means being permanently secured to said bottom wall;

an elongate forward hem formed in said vertically extending forward edge of said substrate;

said elongate forward hem forming an elongate forward loop in said vertically extending forward edge of said substrate;

an elongate, rigid forward hem loop-occupying member slideably disposed in said elongate forward loop;

at least one opening formed in said elongate forward hem;

at least one substrate-tightening strap having a first end disposed in engaging relation to said elongate forward hem-occupying member in registration with said at least one opening;

at least one winch means mounted on said transversely disposed, upstanding front wall;

said elongate forward hem disposed in overlying relation to said transversely disposed, upstanding front wall, said substrate overlying said vertically-extending corner;

said at least one substrate-tightening strap having a second end engaged by said winch means;

whereby differing substrates are securable to and removable from said support surface without removing said permanently secured attachment means from said support surface; and whereby operation of said winch means in a first direction coils said at least one strap about said winch means and thus pulls said substrate to inhibit flexing thereof in response to air movement thereacross, and whereby operation of said winch means in a second direction opposite to said first direction loosens said substrate and facilitates removal of said elongate, rigid forward hem-occupying member from said elongate forward hem.

2. The apparatus in combination with said support surface and said flexible substrate of claim 1, further comprising:

an upper hem formed in said longitudinally extending upper edge of said substrate;

said upper hem forming an elongate upper loop in said longitudinally extending upper edge of said substrate;

an elongate upper hem loop-occupying member disposed in said elongate upper loop;

said upper attachment means provided in the form of a rigid frame disposed along said longitudinally extending upper edge of said side wall;

said upper hem and said elongate upper hem-occupying member being slideably received within and detained by said rigid frame.

3. The apparatus in combination with said support surface and said flexible substrate of claim 1, wherein further comprising:

an elongate rearward hem formed in said vertically extending rearward edge of said substrate;

said elongate rearward hem forming an elongate rearward loop in said vertically extending rearward edge of said substrate;

an elongate, rigid rearward hem loop-occupying member slideably disposed in said elongate rearward loop;

said rearward attachment means provided in the form of a rigid rearward frame attached to said side wall along its vertically extending rearward edge;

said rigid rearward frame having an opening into which is inserted said elongate rearward loop, said elongate, rigid rearward hem loop-occupying member being slideably inserted into said elongate rearward loop after insertion of said elongate rearward loop into said rigid rearward frame so that said substrate can be mounted to said support surface without requiring removal from said support surface of any of said permanently secured attachment means;

said elongate rearward hem and said elongate rearward hem-occupying member being received within and detained by said rigid rearward frame.

4. The apparatus in combination with said support surface and said flexible substrate of claim 1, further comprising:

an elongate lower hem formed in said longitudinally extending lower edge of said substrate;

said elongate lower hem forming an elongate lower loop in said longitudinally extending lower edge of said substrate;

an elongate, rigid lower hem loop-occupying member slideably disposed in said elongate lower loop;

at least one opening formed in said elongate lower hem;

at least one substrate-tightening strap having a first end disposed in engaging relation to said elongate, rigid lower hem-occupying member in registration with said at least one opening;

at least one winch means mounted to said bottom wall so that said at least one winch means does not project outwardly relative to said side wall;

said strap disposed in overlying relation to said bottom wall so that said strap extends over said longitudinally extending corner;

whereby operation of said at least one winch means in a first direction coils said at least one strap about at least one winch means and thus pulls said substrate to inhibit flexing thereof in response to air movement thereacross, and whereby operation of said at least one winch means in a second direction opposite to said first direction loosens said substrate and facilitates removal of said rigid lower hem-occupying member from said elongate lower hem.

5. The apparatus in combination with said support surface and said flexible substrate of claim 4, wherein said at least one opening formed in said elongate lower hem has a longitudinal extent greater than said at least one substrate-tightening strap.

6. The apparatus in combination with said support surface and said flexible substrate of claim 5, further comprising mounting means for said at least one winch means that enables longitudinal displacement of said at least one winch means.

7. The apparatus in combination with said support surface and said flexible substrate of claim 4, wherein said rigid lower hem-occupying member includes a plurality of rigid hem-occupying members that are axially disposed with respect to one another within said elongate lower hem.

8. The apparatus in combination with said support surface and said flexible substrate of claim 1, further comprising a batten means positioned on said substrate to inhibit flapping of the substrate when it is subjected to high speed airflow.

* * * * *